US012179076B2

(12) United States Patent
Ogg

(10) Patent No.: US 12,179,076 B2
(45) Date of Patent: Dec. 31, 2024

(54) LOW DRAG CLUBHEAD

(71) Applicant: Acushnet Company, Fairhaven, MA (US)

(72) Inventor: Steven S. Ogg, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 299 days.

(21) Appl. No.: 17/544,033

(22) Filed: Dec. 7, 2021

(65) Prior Publication Data

US 2023/0173355 A1 Jun. 8, 2023

(51) Int. Cl.
*A63B 60/00* (2015.01)
*A63B 53/02* (2015.01)
*A63B 53/04* (2015.01)

(52) U.S. Cl.
CPC ..... *A63B 60/006* (2020.08); *A63B 53/023* (2020.08); *A63B 53/0408* (2020.08); *A63B 53/0433* (2020.08); *A63B 53/0437* (2020.08); *A63B 53/0466* (2013.01)

(58) Field of Classification Search
CPC . A63B 60/006; A63B 53/0466; A63B 53/023; A63B 53/0437; A63B 53/0408; A63B 53/0433
USPC ..... 473/324–350, 287–292
See application file for complete search history.

(56) References Cited

U.S. PATENT DOCUMENTS 5,935,020 A * 8/1999 Stites ..... A63B 60/00 473/345
8,177,659 B1 5/2012 Ehlers
8,568,247 B1 10/2013 Ehlers
8,758,157 B1 6/2014 Ehlers
8,784,234 B2 * 7/2014 Lacey ..... A63B 53/0466 473/345
9,433,833 B2 9/2016 Ehlers
11,247,105 B2 * 2/2022 Beach ..... A63B 60/00
2010/0016097 A1 * 1/2010 Albertsen ..... A63B 53/0466 473/345
2011/0136584 A1 * 6/2011 Boyd ..... A63B 60/52 473/345
2012/0316007 A1 * 12/2012 Burnett ..... A63B 53/0466 473/327

(Continued)

OTHER PUBLICATIONS

Covey, Tony, COBRA LTDx Drivers, MyGolfSpy.com, Jan. 19, 2022, retrieved on May 11, 2022, https://mygolfspy.com/cobra-ltdx-drivers/.

*Primary Examiner* — Sebastiano Passaniti
(74) *Attorney, Agent, or Firm* — Lewis Roca Rothgerber Christie LLP

(57) ABSTRACT

Golf club heads with improved aerodynamic properties. In an example, the golf club head has a club head frontmost point and a club head rearmost point. The golf club head may include a striking face and a sole connected to a bottom side of the striking face. The sole has a rearmost point and may have a closing ascent angle of less than about 35 degrees. The club head also includes a crown connected to a topside of the striking face. The crown has a rearmost point and may have a closing descent angle of less than about 35 degrees. The closing descent angle may also be within 85%-115% of the closing ascent angle of the sole. Toeward and heelward tripping structures may also be incorporated on the hosel to further improve aerodynamic properties of the golf club head.

25 Claims, 13 Drawing Sheets

(56) References Cited

U.S. PATENT DOCUMENTS

| | | | | |
|---|---|---|---|---|
| 2014/0066224 | A1* | 3/2014 | Albertsen | A63B 53/0466 473/327 |
| 2017/0021236 | A1* | 1/2017 | Ghods | A63B 60/52 |
| 2018/0200586 | A1* | 7/2018 | Stites | A63B 60/00 |
| 2019/0001198 | A1* | 1/2019 | Burnett | A63B 53/0466 |
| 2022/0111266 | A1 | 4/2022 | Henrikson et al. | |

* cited by examiner

| Club Head Number | $H_{RC}$ (mm) | $H_{RS}$ (mm) | $T_{Rear}$ (mm) | $L_{FB}$ (mm) | $\Phi_{1/2}$ | $\Phi_{1/3}$ | $\theta_{1/2}$ | $\theta_{1/3}$ |
|---|---|---|---|---|---|---|---|---|
| Example 1 | 36.4 | 19.6 | 17 | 112.9 | 24.3 | 29.4 | 17 | 18.5 |
| Example 2 | 36.4 | 22.8 | 13.7 | 112.9 | 24.3 | 29.4 | 19.9 | 22.6 |
| Example 3 | 36.4 | 26.2 | 10.3 | 112.9 | 24.3 | 29.4 | 22.6 | 26.5 |
| Example 4 | 30.1 | 13.2 | 17 | 112.8 | 28 | 32 | 11.3 | 12.2 |
| Example 5 | 30.1 | 16.4 | 13.8 | 112.8 | 28 | 32 | 13.7 | 13.9 |
| Example 6 | 30.1 | 19.7 | 10.5 | 112.8 | 28 | 32 | 16.7 | 18.1 |
| Example 7 | 42.7 | 26.1 | 16.8 | 112.8 | 19.4 | 24.3 | 22.8 | 25.9 |
| Example 8 | 42.7 | 29.4 | 13.5 | 112.8 | 19.4 | 24.3 | 25.4 | 29.7 |
| Example 9 | 42.7 | 32.6 | 10.3 | 112.8 | 19.4 | 24.3 | 27.9 | 33 |
| Example 10 | 37.4 | 19.6 | 17 | 113.4 | 24.4 | 29.5 | 17 | 18.5 |

FIG. 10

LOW DRAG CLUBHEAD

BACKGROUND

During the game of golf, a golfer may often desire to hit a golf ball further. For instance, with a driver, the golfer may desire to hit the golf ball as far as possible. One factor in the distance the golf ball travels is the club head speed of the golf club as it is being swung. As a golf club is swung by a golfer, the golf club experiences significant drag effects that require greater power from the golfer to achieve higher swing speeds. Thus, a reduction in drag of the golf club head allows for higher club head speeds with the same amount of effort from the golfer.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe improved golf club heads with improved aerodynamic properties. In an aspect, the technology relates to a metal-wood type golf club head having improved aerodynamic properties, the golf club head having a club head frontmost point and a club head rearmost point. The golf club head includes a striking face, the striking face defining the frontmost point; a sole connected to a bottom side of the striking face, the sole having a rearmost point and a closing ascent angle of less than about 35 degrees, wherein the closing ascent angle is: an angle between (1) a line from the rearmost point of the sole to a sole point, of a projected silhouette of the golf club head from a toe-side viewpoint, located one third a front-to-back length from the club head rearmost point, as measured along a ground plane, and (2) a plane intersecting the sole point and parallel to the ground plane; and a crown connected to a topside of the striking face, the crown including a rearmost point and a closing descent angle of less than about 35 degrees. The closing descent angle is: an angle between (1) a line from the rearmost point of the crown to a crown point, of the projected silhouette of the golf club head from the toe-side viewpoint, located one third a front-to-back length from the club head rearmost point, as measured along a ground plane, and (2) a plane intersecting the crown point and parallel to the ground plane; and within 85%-115% of the closing ascent angle of the sole.

In an example, a club head height of the golf club head is at least 2 inches, and a club head length is greater than 4.0 inches. In another example, the golf club head further includes a skirt, wherein rearmost point on the sole is an intersection point of the sole and a lower boundary of the skirt, and the rearmost point on the crown is an intersection point of the crown and an upper boundary of the skirt. In still another example, the lower boundary is a skirt height above the ground plane, and the skirt height satisfies a head-length-to-skirt-height ratio between 3:1 and 8:1. In a further example, the skirt height is between 12-35 mm. In yet another example, the skirt has a skirt thickness that satisfies a head-length-to-skirt-thickness ratio of 6:1 and 11:1.

In another example, the skirt thickness is between 8-20 mm. In a further example, the closing ascent angle is less than 30 degrees and the closing descent angle is less than 30 degrees. In still another example, the closing ascent angle is within 95%-105% of the closing ascent angle of the sole.

In another aspect, the present technology relates to a metal-wood type golf club head having improved aerodynamic properties. The golf club head includes a striking face, the striking face defining a frontmost point of the golf club head; a sole connected to a bottom side of the striking face; a crown connected to a topside of the striking face; a hosel at a heelward side of the golf club head, the hosel including a hosel opening configured to receive a golf club shaft defining a shaft axis. The hosel includes a first tripping structure extending in a direction from the hosel opening towards the sole, the first tripping structure having a height or depth of between 0.005 inches and 0.03 inches; and a second tripping structure extending a direction from the hosel opening towards the sole, the second tripping structure having a height or depth of between 0.005 inches and 0.03 inches and the second tripping structure located apart from the first tripping structure by angular position of 70-170 degrees, as measured around the shaft axis. The golf club head further includes a skirt connected to, and located in between, the crown and the sole, wherein the skirt includes an aft skirt portion at a rear of the golf club head, wherein the aft skirt portion has: a rearmost point that is a head length from the frontmost point of the striking face; a lower boundary located at an intersection of the skirt and sole, wherein the lower boundary is a skirt height above ground plane, the skirt height satisfies a head-length-to-skirt-height ratio between 3:1 and 8:1; and a skirt thickness that satisfies a head-length-to-skirt-thickness ratio of 5:1 and 14:1. In an example, the skirt thickness is between 8-20 mm. In another example, the skirt height is between 12-35 mm.

In another aspect, the present technology relates to a metal-wood type golf club head having improved aerodynamic properties. The golf club head includes a striking face; a sole connected to a bottom side of the striking face; a crown connected to a topside of the striking face; and a hosel at a heelward side of the golf club head, the hosel including a hosel opening configured to receive a golf club shaft defining a shaft axis. The hosel includes a toeward tripping structure extending in a direction from the hosel opening towards the sole, the toeward tripping structure having a height or depth of between 0.005 inches and 0.03 inches, the toeward tripping structure being positioned at a shaft-axis angular position of 0-80 degrees measured around the shaft axis, wherein a zero-degree shaft-axis angular position corresponds to a direction forward of the golf club head and perpendicular to a plane defined by the striking face; and a heelward tripping structure extending a direction from the hosel opening towards the sole, the heelward tripping structure having a height or depth of between 0.005 inches and 0.03 inches, the heelward tripping structure being positioned at a shaft-axis angular position of 260-340 degrees measured around the shaft axis.

In an example, a position of the toeward tripping structure and a position of the heelward tripping structure are substantially symmetric about a line extending along a 350 degree shaft-axis angle, wherein a zero-degree shaft-axis angular position corresponds to a direction forward of the golf club head and perpendicular to a plane defined by the striking face. In another example, the toeward tripping structure is located at a shaft-axis angular position of 30-60 degrees and the heelward tripping structure is located at a shaft-axis angular position of 280-310 degrees. In yet another example, the heelward tripping structure is located apart from the toeward tripping structure by angular position of less than 100 degrees, as measured around the shaft axis. In still another example, the golf club head further includes a second toeward tripping structure and a third toeward tripping structure, the second toeward tripping structure and the third toeward tripping structure located within 30 degrees of the toeward tripping structure, as measured around the shaft axis.

In another example, the toeward tripping structure is one of a ridge or a groove; and the heelward tripping structure is one of a ridge or a groove. In yet another example, the toeward tripping structure has a length of at least 40 mm, and wherein the hosel is configured to cause tripping from laminar flow to turbulent flow around the hosel at a Reynolds number characteristic of flow conditions experienced by golfers. In still another example, the hosel is adjustable and includes an adjustable component having multiple setting positions, wherein the adjustable component includes a portion of a tripping structure for each setting position such that, at each setting position, one of the tripping structure portions aligns with remaining tripping structure portions on the hosel.

In another aspect, the technology relates to a golf club head that includes a striking face, the striking face defining a frontmost point of the golf club head; a sole connected to a bottom side of the striking face; a crown connected to a top side of the striking face, wherein an aft slice of the golf club head has a centroid height ($H_{centroid}$) that is at least 95% of a height of a geometric center of the striking face above a ground plane and a height ($H_{Low}$) of a lowest point of the aft slice is at least 40% of the height of the geometric center of the striking face above the ground plane, the aft slice being a portion of the golf club head to a rear of a slice line and between an outer perimeter of the golf club head and an offset perimeter slice curve. The slice line extends in a heel-to-toe direction and is located a slice depth rearward from the frontmost point and the slice depth is equal to 70% of a front-to-back length of the golf club head. The offset perimeter slice curve is offset from the outer perimeter of the golf club head by a perimeter offset distance of 0.5 inches.

In an example, the centroid height is equal to at least 50% of a club head height of the golf club head. In another example, the centroid height is at least 28 mm. In still another example, a club head height of the golf club head is at least 2 inches, and a club head length greater than 4.0 inches. In a further example, the centroid height ($H_{centroid}$) is less than 35 mm. In yet another example, the height ($H_{Low}$) of the lowest point of the aft slice is at least 10 mm and less than 15 mm above the ground plane.

In another example, a second aft slice of the golf club head has a centroid height ($H_{centroid}$) of at least 28 mm and a height ($H_{Low}$) of a lowest point of the second aft slice is greater than 6 mm above the ground plane, the second aft slice being a portion of the golf club head to the rear of a second slice line and between the outer perimeter of the golf club head and a second perimeter slice curve. The second slice line extends in the heel-to-toe direction and is located a second slice depth rearward from the frontmost point, the second slice depth being equal to 60% of the front-to-back length of the golf club head; and the second perimeter slice curve is offset from the outer perimeter of the golf club head by a second perimeter offset distance of 1.0 inches.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

FIG. 10 depicts dimensions of example golf club heads.

DETAILED DESCRIPTION

Due to the swing speeds and the shape of golf club heads, many golf clubs, or parts thereof, operate in a Reynolds number regime in which the state of the viscous boundary layer is typically laminar unless forced to a turbulent state by a tripping structure. On bluff bodies, such as the hosel of a golf club, the laminar boundary layer will separate creating a large wake with a relatively low-pressure region. This low pressure acting on the aft facing surface area results in a drag force that retards the speed of the clubhead at impact. In particular, hosels on golf clubs are often constructed having a circular (or nearly so) cross section. Circular cylinders at subcritical (prior to natural transition) Reynolds numbers have a relatively high drag coefficient as compared to those operating with a turbulent boundary layer. By forcing the transition to occur with a tripping structure the drag can be reduced with a resultant increase in clubhead speed. Due to the rotation of the golf club head, the location and dimensions of the tripping structures become important to create the transition from the laminar flow to the turbulent flow.

In addition to tripping structures on the hosel of the golf club head, the shape of the golf club head may also be altered to improve its aerodynamic properties. For instance, changing the shape of the golf club head, such as the striking face, crown, and sole, causes changes in drag experienced by the golf club head during a swing of the golf club head. As an example, what is commonly perceived as an improved aerodynamic shape to the golf club head is to have the crown and the sole meet a singular point at the aft of the golf club head, such as to form a teardrop shape of the golf club head that has a sharper trailing edge. The present technology, however, goes against that traditional perception of the teardrop shape while still lowering drag and improving the overall aerodynamic properties of the golf club head. For instance, the traditional teardrop shape causes a high closure angle of the crown and/or the sole. This high closure angle causes an earlier, or more forward, separation of the turbulent flow over the crown and the sole, which increases the pressure drag experienced by the golf club head during a swing. The present technology changes, and reduces, the closure angles of the crown and/or the sole to move the separation of the turbulent flow further towards the aft the golf club. These reduced closure angles result in a golf club head that may look less aerodynamic but actually results in a golf club that experiences less pressure drag forces and has overall improved aerodynamic properties. The changes to the closure angles of the crown and/or the sole may be accomplished, for example, by raising an aft portion of the skirt further above the ground plane and/or increasing the thickness of the aft portion of the skirt.

Figure 1:
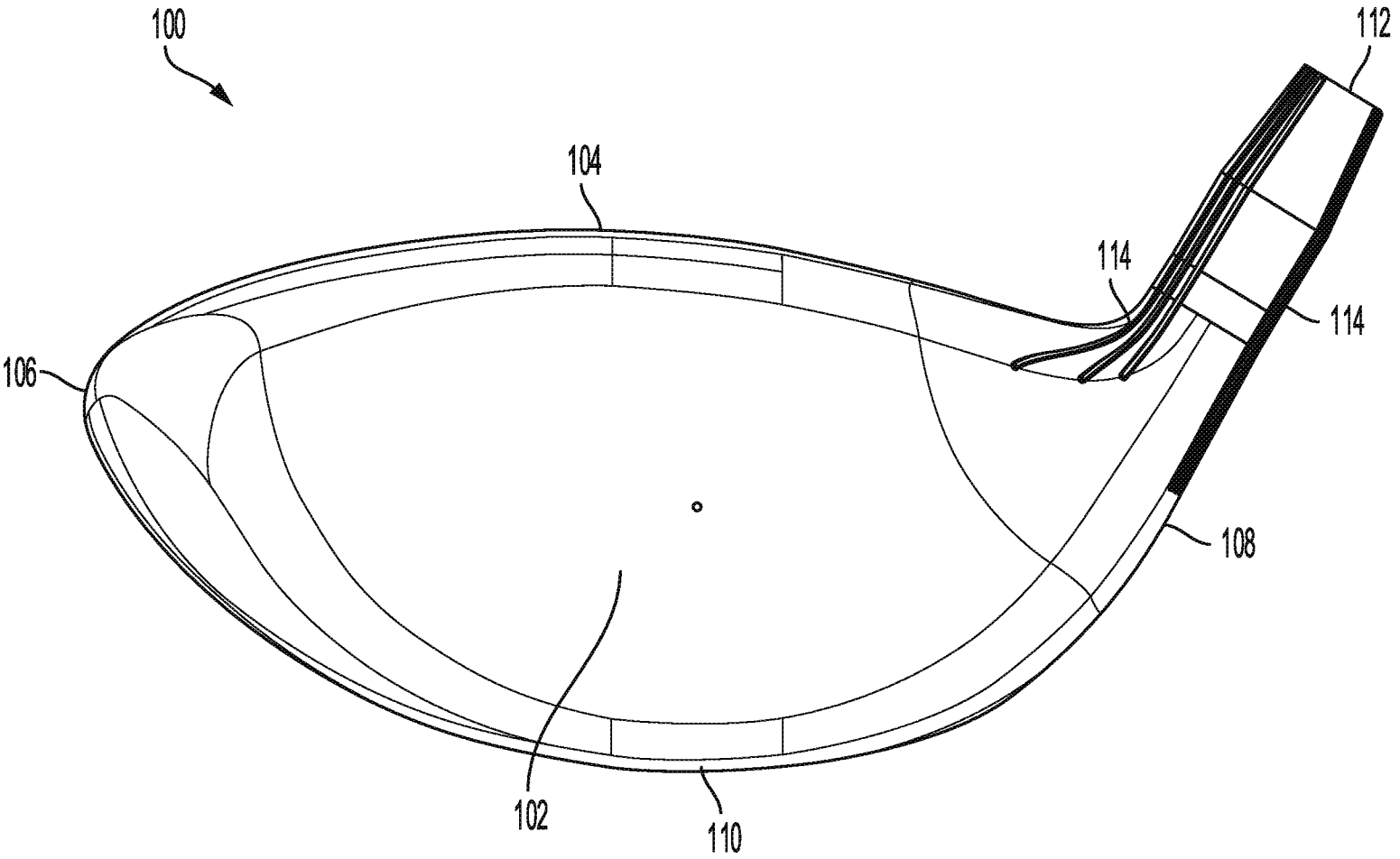
FIG. 1 depicts a front view of an example golf club head including a plurality of tripping structures.
Figure 2:
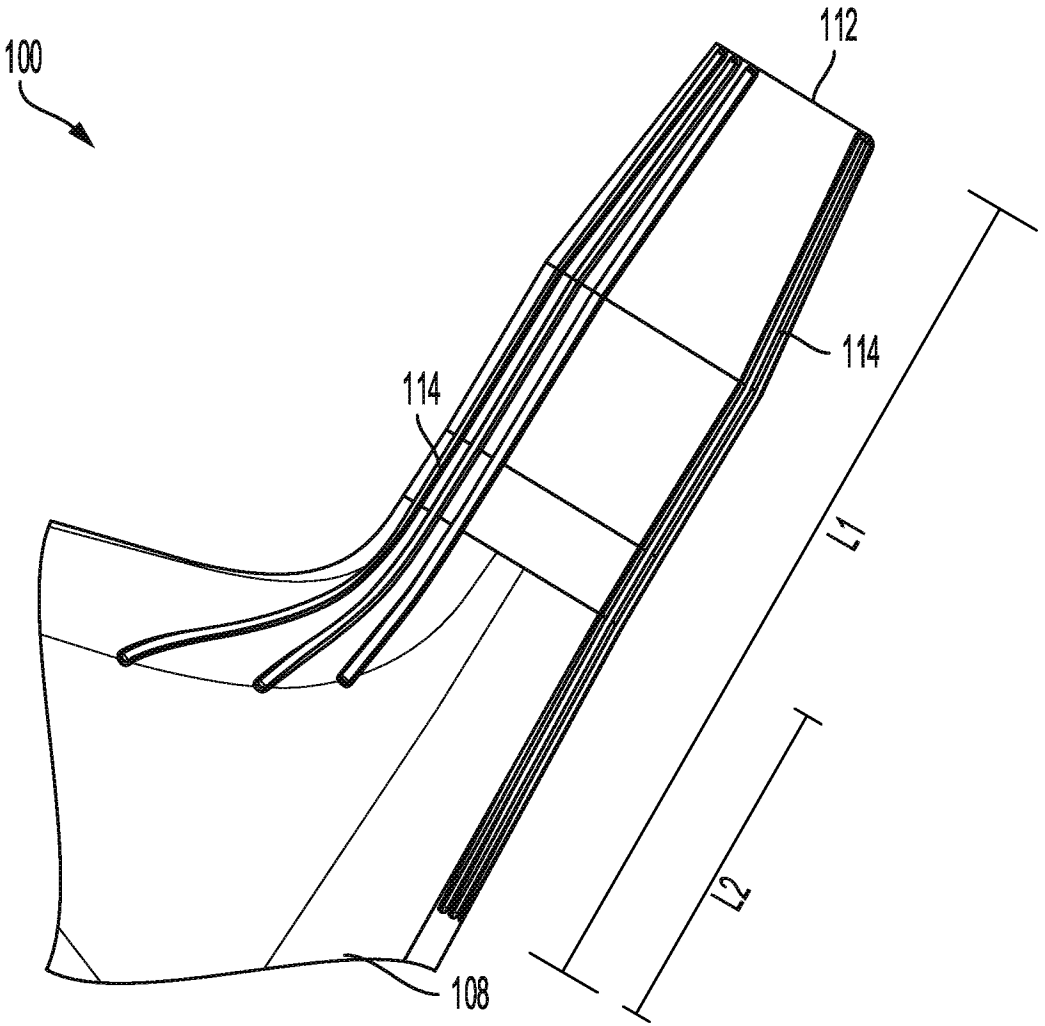
FIG. 2 depicts a front view of a hosel of the golf club head of FIG. 1.

FIG. 1 depicts a front view of an example golf club head 100 including a plurality of tripping structures 114. FIG. 2 depicts an enlarged front view of a hosel of the golf club head of FIG. 1. FIGS. 1-2 are discussed concurrently. The golf club head 100 is metal-wood type golf club head, such as a driver or a fairway metal. The golf club head 100 includes a striking face 102, a crown 104, a toe region 106, a heel region 108, and a sole 110. The crown 104 and the sole 110 may be attached to the striking face 102. For instance, the crown 104 is attached to a topside of the striking face 102 and the sole 110 is attached a bottom side of the striking face 102.

The golf club head 100 also includes a hosel 112. The hosel 112 is used to attach a shaft (not depicted) to the golf club head 100. The hosel 112 may be formed into at least a portion of the crown 104 and the heel portion 108. The hosel 112 may also include a ferrule or components of an interchangeable shaft system.

The hosel 112 also includes a plurality of tripping structures 114. In the example depicted, the tripping structures 114 are formed as elongate ridges extending from the top of the hosel towards the sole. This particular pattern has three substantially parallel ridges on both the heelward and toeward side of the hosel. The height of the ridges (e.g., the distance the ridges protrude from the surface of the hosel) may be between 0.005 inches and 0.03 inches. In some examples, the height of the ridges is between 0.009 inches and 0.015 inches.

The length (L1) of the tripping structures 114 may be between 30-70 mm. In some examples, the length (L2) of the tripping structures 114 may be greater than 40 mm. The length of the tripping structures 114 may also be considered as two components, a first length component that extends through a ferrule and any additional hosel components (e.g., adjustable shaft components, rings, sleeves, etc.) and a second length component extending across the body of the club head 100, such as the heel region 108 of the club head 100. The second length component is represented as L2 in FIG. 2, and represents the length of the tripping structures 114 across the body of the club head 100. The second length component (L2) may be between 15-35 mm, 20-30 mm, and/or may be at least 20 mm. In some examples, the heelward tripping structures and the toeward tripping structures 114 may have the same length. In other examples, the heelward tripping structures 114 may have a greater length than the toeward tripping structures 114. In yet other examples, the toeward tripping structures 114 may have a greater length than the heelward tripping structures 114.

Figure 3A:
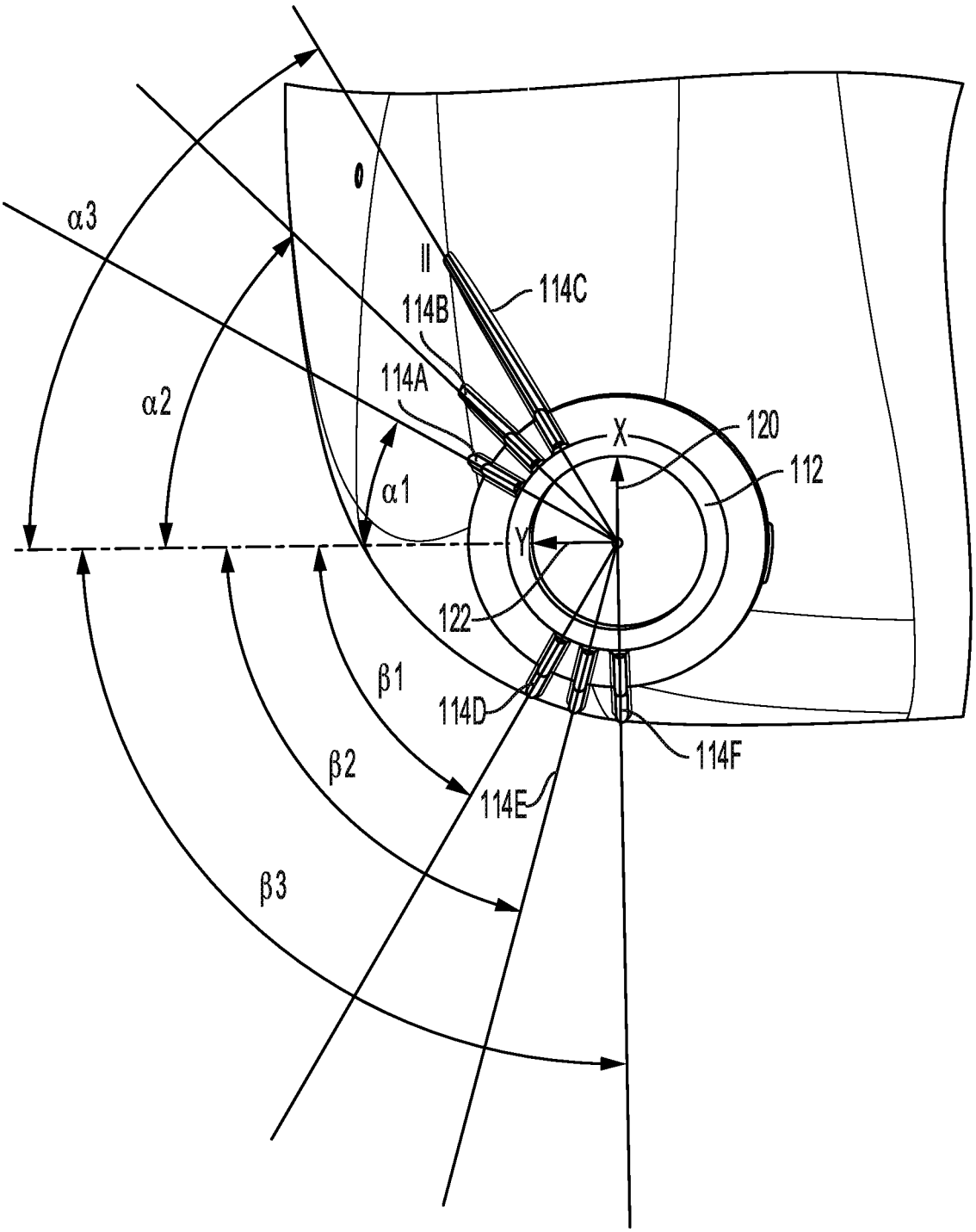
FIGS. 3A-3B depict top views of the hosel of the golf club head of FIG. 1.
Figure 3B:
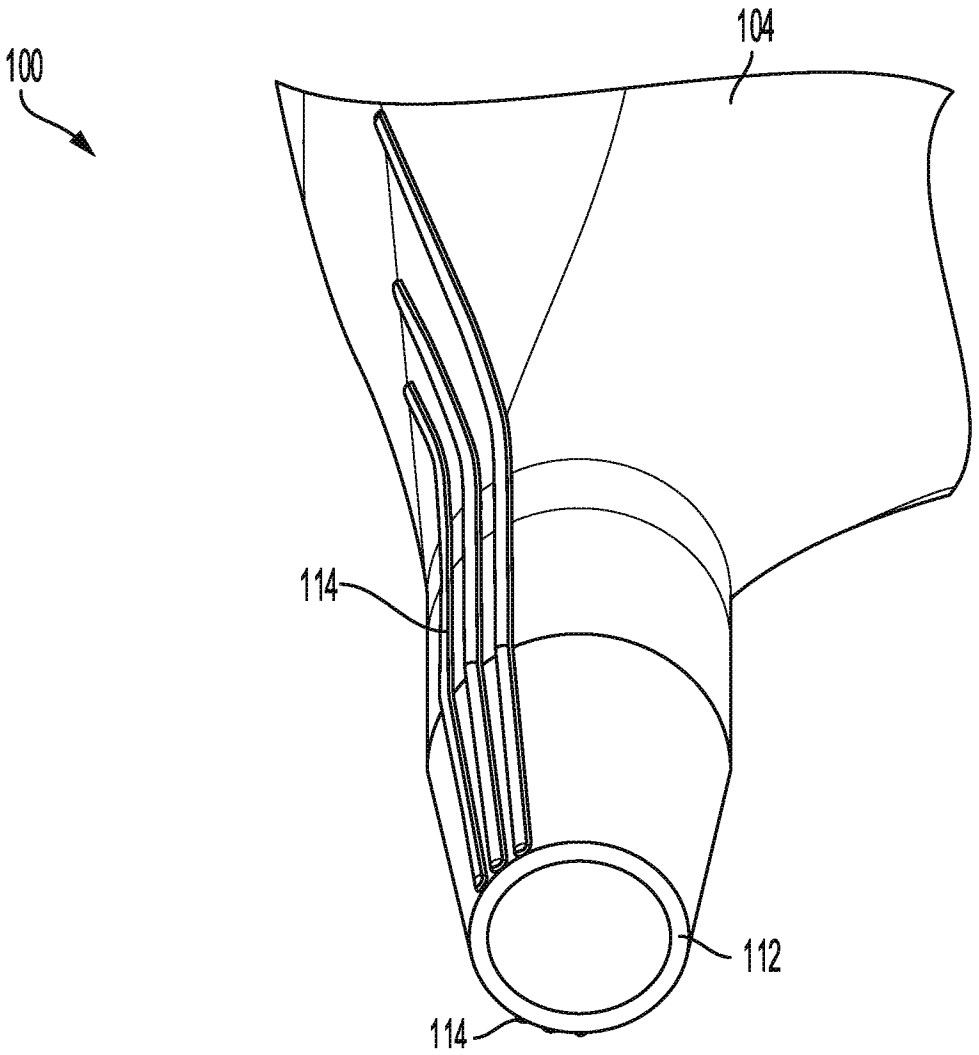
Figure 4:
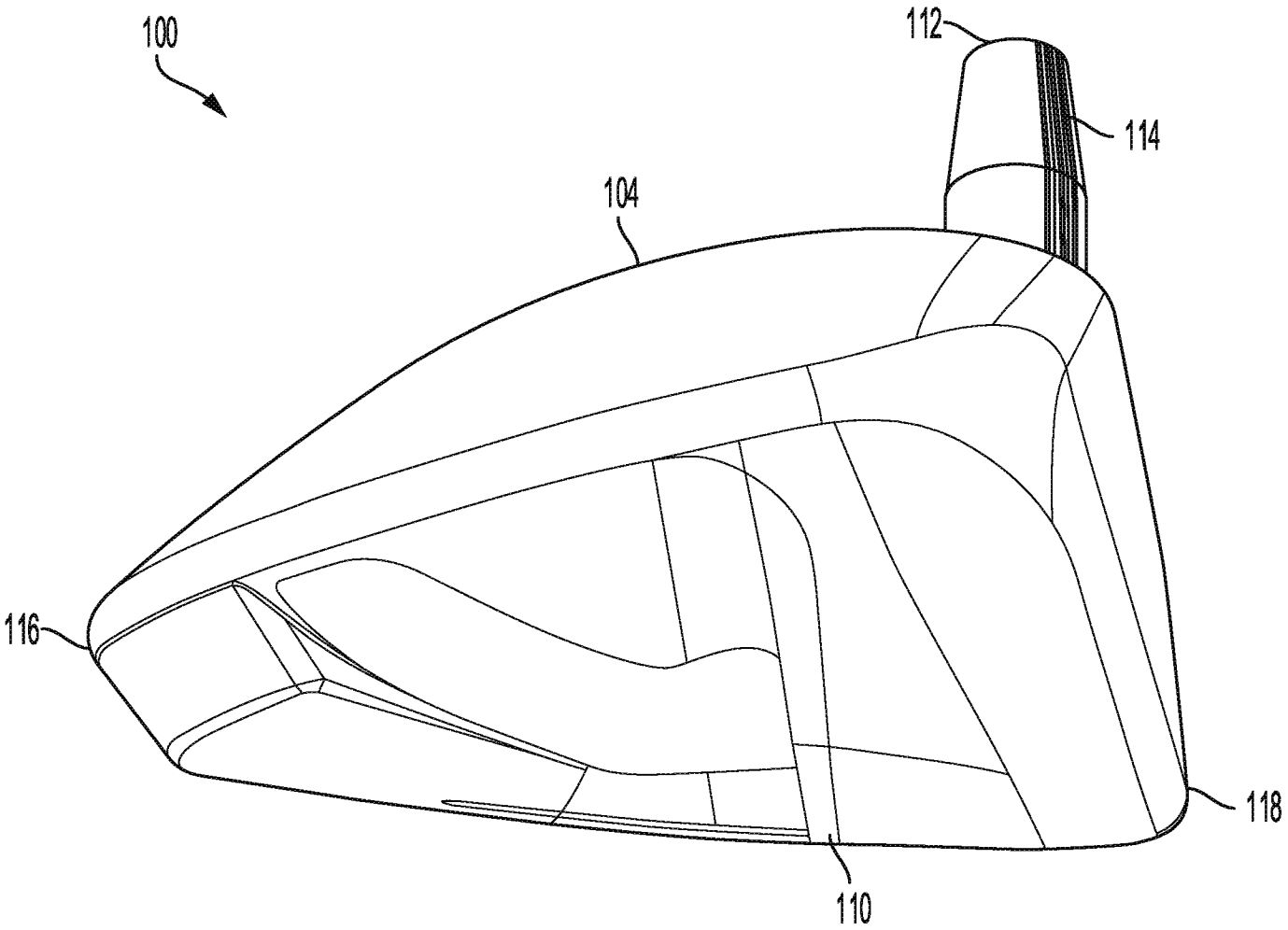
FIG. 4 depicts a toe-side view of the golf club head of FIG. 1.
Figure 5:
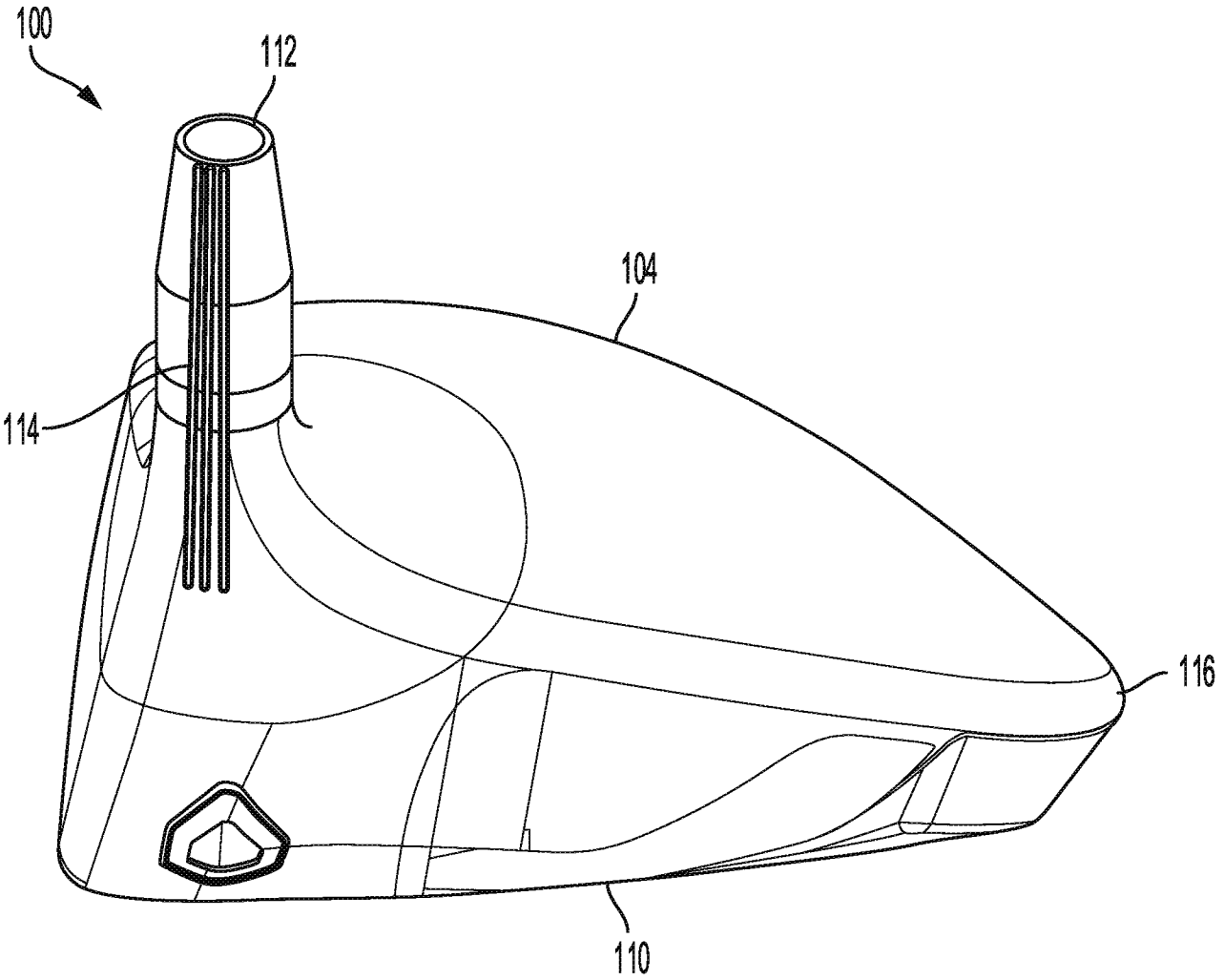
FIG. 5 depicts a heel-side view of the golf club head of FIG. 1.

FIGS. 3A-3B depict top views of the hosel of the golf club head of FIG. 1. FIG. 4 depicts a toe-side view of the golf club head of FIG. 1, and FIG. 5 depicts a heel-side view of the golf club head of FIG. 1. As can be seen from FIGS. 4-5, the golf club head 100 includes a rearmost point 116 (e.g., a trailing edge) and a frontmost point 118 (e.g., a leading edge). FIGS. 3A-3B, 4, and 5 are discussed concurrently.

FIG. 3A depicts a view down the shaft axis (e.g., an axis formed by a shaft that would be connected to the hosel) of the golf club head 100 and indicates the angular positions of the tripping structures with respect to the shaft axis. In FIG. 3A, the three toeward tripping structures 114 are individually labeled as a first toeward tripping structure 114A, a second toeward tripping structure 114B, and a third toeward tripping structure 114C. The three heelward tripping structures are also individually labeled as a first heelward tripping structure 114D, a second heelward tripping structure 114E, and a third heelward tripping structure 114F.

The locations or positions of the tripping structures 114 account for the rotational movement of the club head during a swing of a golf club head. For instance, during the downswing of golf club, the heelward tripping structures 114D-F are more exposed to the airflow, whereas at impact and during the follow through, the toeward tripping structures 114A-C are more exposed to the airflow. Due to the toeward tripping structures 114A-C being located more towards the striking face 102, the toeward tripping structures 114A-C also provide tripping effects during the downswing of the golf club head 100.

The location or position of each of the tripping structures 114 may be described as an angular position around the shaft axis. The angular positions may be described as relative to a toe-to-heel axis 120 or a front-to-back axis 122. The front-to-back axis 122 is an axis that runs from the front of the golf club head 100 to the back of the golf club head, and the toe-to-heel axis 120 is an axis that runs from the toe to heel of the golf club head 100 and is substantially perpendicular to the front-to-back axis 122. For instance, the front-to-back axis 122 may be perpendicular to a plane defined by the striking face 102. In the examples used herein, the front-to-back axis 122 has a zero-degree position pointing forward of the golf club head 100. For instance, the zero-degree shaft-axis angular position may correspond to a direction forward of the golf club head 100 and perpendicular to the plane defined by the striking face 102. The origin of the front-to-back axis 122 and the toe-to-heel axis 120 may be located at the center of the hosel (e.g., at the shaft axis).

The tripping structures 114 on the toeward side of the front-to-back axis 122 are referred to as the toeward tripping structures 114, and the tripping structures 114 that are on the heelward side of the front-to-back axis 122 are referred to as the heelward tripping structures 114. As measured from the front-to-back axis 122, the first toeward tripping structure 114A is located 30 degrees around the shaft axis, as represented by angle $\alpha 1$, as measured in a clockwise direction. The second toeward tripping structure 114B is offset by 15 degrees around the shaft axis from the first toeward tripping structure 114A. The third toeward tripping structure 114C is offset by 15 degrees from the third toeward tripping structure 114C. In other words, the second toeward tripping structure 114B is located 45 degrees around the shaft axis, as represented by angle $\alpha 2$, and the third toeward tripping structure 114C is located 60 degrees around the shaft axis, as represented by angle $\alpha 3$.

Of note, the toeward tripping structures 114A-C are located towards the front of the golf club head 100 from the toe-to-heel axis 120. In other words, the toeward tripping structures are located between 0-90 degrees around the shaft axis as measured from the front-to-back axis 122. By positioning the toeward tripping structures 114A-C towards the front of the golf club head 100, the toeward tripping structures 114A-C are able to provide the tripping effect for more of the downswing of the golf club as the golf club rotates from an open position to a closed position.

As also measured from the front-to-back axis 122, the first heelward tripping structure 114D is located −60 degrees around the shaft axis, as represented by the angle β1. The second heelward tripping structure 114E is offset by 15 degrees around the shaft axis from the first heelward tripping structure 114D. The third heelward tripping structure 114F is offset by 15 degrees around the shaft axis from the second heelward tripping structure 114E. In other words, the second heelward tripping structure 114E is located −75 degrees around the shaft axis, as represented by angle β2, and the third heelward tripping structure 114F is located −90 degrees around the shaft axis, as represented by angle β3. In some examples, the heelward tripping structures may be more easily measured from the toe-to-heel axis 120. For instance, the third heelward tripping structure 114F is aligned with, or parallel to, the heel-to-toe axis 120.

The first toeward tripping structure 114A may be referred to as the frontmost toeward tripping structure 114A, and the first heelward tripping structure 114A may be referred to as the frontmost heelward tripping structure 114D. The frontmost toeward tripping structure 114A and the frontmost heelward tripping structure 114D in the example depicted are positioned 90 degrees apart from one another.

The angular positions of the tripping structures 114 described above are for a particular example, and some variations on the angular positions may also be implemented to achieve the tripping effects described herein. For example, the toeward tripping structures 114 may be located within 0-80 degrees, 10-80 degrees, 10-70 degrees, and/or 30-70 degrees around the shaft axis as measured from the front-to-back axis 122. The heelward tripping structures 114 may be located between −30 to −90, −50 to −90, −60 to −90, and/or −40 to −110 degrees around the shaft axis as measured from the front-to-back axis 122.

The toeward tripping structures 114 and/or the heelward tripping structures 114 may be spaced from one another by an angular amount of 5−25 degrees and/or 10−20 degrees. In some examples, such as the one depicted in FIG. 3A, the toeward tripping structures 114A-C and/or the heelward tripping structures 114D-F may be evenly spaced from one another.

One or more of the toeward tripping structures 114A-C may be symmetrically positioned about radial line of 350 degree (i.e., −10 degree) shaft-axis angle from one or more of the heelward tripping structures 114D-F. For instance, a position of the toeward tripping structure and a position of the heelward tripping structure may be substantially symmetric about a line extending along a 350 degree shaft-axis angle. Such symmetry may improve the overall aerodynamic properties of the hosel 112. As an example, a toeward tripping structure being positioned at a shaft-axis angular position of 0−80 degrees measured around the shaft axis, and a heelward tripping structure may be positioned, symmetrically about the 350 degree line, at a shaft-axis angular position of 260−340 degrees measured around the shaft axis. the toeward tripping structure is located at a shaft-axis angular position of 30−60 degrees and the heelward tripping structure is located at a shaft-axis angular position of 280−310 degrees.

The heights, lengths, and locations of the tripping structures 114 discussed herein are able to trigger a transition from a laminar flow to a turbulent flow around the hosel at the Reynolds numbers and swing speeds typically associated with the swinging of a golf club head. For instance, the tripping structures 114 may be configured to cause tripping from laminar flow to turbulent flow around the hosel at a Reynolds number characteristic of flow conditions experienced by golfers (such as less than 30,000), as the hosel 112 of the golf club head 100 usually is within a 20,000 to 50,000 Reynolds number regime. In addition, the dimensions and locations of the tripping structures 114 are important for causing the transition from the laminar flow to turbulent flow in the proper location. For example, if the tripping occurs too early, the flows will fully separate and not reattach, or if there is a very strong favorable gradient, the flows will relaminarize and then separate-both of which may actually increase drag. The present dimensions and locations of the tripping structures 114 prevent such adverse phenomenon even when the golf club head rotates during a golf swing.

While the tripping structures 114 shown in FIGS. 1-5 are ridges that protrude outwardly from the hosel, in other examples, the tripping structures 114 may take different forms. For instance, the tripping structures 114 may be formed as grooves rather than ridges. The depth of the grooves may be the same as the height of the ridges discussed herein. The grooves may also have similar lengths and positions as the ridges. In some examples, grooves and ridges may be utilized, and the height may be considered an amplitude measured from the peak of the ridge to the valley of the groove.

The tripping structures 114 may also be formed from tooling marks, that have adequate roughness to transition the boundary layer, positioned in similar locations and orientations as the ridges discussed above. Additional patterns, such as three-dimensional sine waves that are roughly axisymmetric with respect to the shat or hosel axis, may also be used. The sine waves may also be a function of both position along the shaft or hosel axis and the circumferential position around the hosel. A three-dimensional pattern of interconnect ridges, such as a hexagonal pattern, may also be used as tripping structures 114. Dimples or pimples (e.g., the opposite of dimples) may also be used as tripping structures 114 in some examples.

Figure 6:
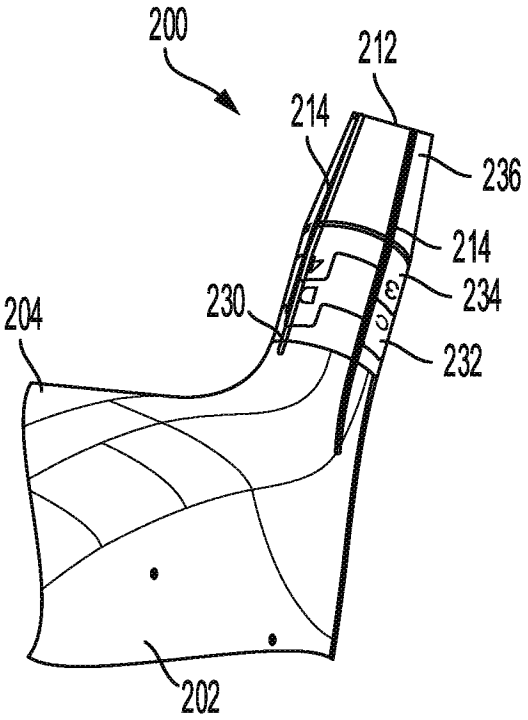
FIG. 6 depicts an adjustable hosel including tripping structures.

FIG. 6 depicts a partial perspective view of a golf club head 200 with an adjustable hosel 212 including tripping structures 214. As with the other examples described above, the golf club head 200 has a striking face 202 and a hosel 212 extends from the crown 204. The adjustable or configurable hosel 212 may be a part of a shaft connection system, and/or the configurable hosel 212 may be adjusted to change characteristics of the golf club head 200, such as the loft and/or lie characteristics of the golf club head 200.

The example configurable hosel 212 depicted in FIG. 6 is similar to the SUREFIT® hosel system from the Acushnet Company of Fairhaven, Massachusetts. The configurable hosel 212 includes a fixed portion 230 attached to the club head 200 near the crown 204 and two configurable or adjustable components: a rotatable ring 232 and a rotatable sleeve 234. The fixed portion 230, the rotatable ring 232, and the rotatable sleeve 234 each include a series of tangs and notches. When the configurable hosel 212 is tightened together, the tangs fit into the notches. By rotating the ring 232 and the sleeve 234, multiple different configuration states for the configurable hosel 212 may be achieved. In the example depicted, the ring 232 includes four different settings as indicated by letter markings A-D, with each setting including a different tang on the ring 232. The sleeve 234 similarly has four different settings as indicated by number markings 1–4, with each setting including a different tang on the sleeve 234. The configuration state of the configurable hosel 212 corresponds to the settings of the ring 232 and the sleeve 234 that are aligned with an alignment reference indicator on the fixed portion 230. A ferrule 236 may also be included. Additional details regarding a similar configurable hosel system may be found in U.S. Pat. No. 9,403,067, titled "Interchangeable Shaft System," which is incorporated herein by reference in its entirety.

The configurable hosel 212 also includes tripping structures 214. The tripping structures 214 may be divided into separate pieces or portions corresponding to the number of different components in the configurable hosel 212. In the example depicted, there are four components of the adjustable hosel 212—the fixed portion 230, the rotatable ring 232, the rotatable sleeve 234, and the ferrule 236. The tripping structures 214 extend across each of the four components. To allow for adjustment of the adjustable hosel 212, each of the tripping structures are separated into four pieces corresponding to the four different components of the adjustable hosel 212. For instance, each tripping structure 214 may have a first piece on the ferrule 236, a second piece on the sleeve 234, a third piece on the ring 232, and a fourth piece on the fixed portion 230. Each of the pieces of the tripping structure 214 may be separated from one another, such as by a cut, or the pieces of the tripping structures 214 may be separately formed as part of the respective components, such as the ring 232 and the sleeve 234. Accordingly, as the adjustable components of the hosel 212 (e.g., the ring 232 and the sleeve 234) are rotated, the corresponding piece of the tripping structure 214 move with the respective adjustable component. For example, the pieces of tripping structures 214 located on the ring 232 move with the ring 232 as the ring 232 is rotated.

The number and/or positions of the tripping structures 214 may be based on the number of different settings available from the adjustable components of the hosel 212. In the example depicted, the ring 232 and the sleeve 234 each have four possible settings (e.g., settings A-D and settings 1-4). Accordingly, four tripping structures 214 may be incorporated into the hosel 212. Each of the four setting positions on the ring 232 and the sleeve 234 are offset by 90 degrees (e.g., 360 degrees divided by four). Thus, the four tripping structures 214 are also offset from one another by 90 degrees. As a result, in any setting combination of the ring 232 and the sleeve 234, the respective pieces of the tripping structures 214 align with other pieces of the tripping structures 214 to form the full-length tripping structures 214. With the offsets of 90 degrees, the tripping structures 214 may be located in the angular positions discussed above with respect to FIGS. 1-5. The pieces of the tripping structures 214 on the adjustable components of the hosel 212 may also be made such that all the pieces have the same size and shape (e.g., same thickness, length, width, cross-section, etc.), which further allows for consistent forming of the full tripping structures 214 in any of the settings of the adjustable components.

As another example, if the adjustable components have only three settings, three tripping structures 214 may be included and may be offset by 120 degrees, whereas if the adjustable components have five settings, five tripping structures 214 may be incorporated and may be offset by 72 degrees. The number of tripping structures 214 may be equal to the number of settings, and the offset angle of the tripping structures 214 may be based on the offset angles of the different settings of the adjustable components. In some examples, multiple tripping structures 214 may be included on each of the different settings (such as the tangs of the ring 232). In such examples, the number of tripping structures 214 may be equal to a multiple of the number of settings. For instance, for an adjustable component with four settings, 4, 8, 12, or 16 tripping structures 214 may be included on the hosel 212.

Figure 7:
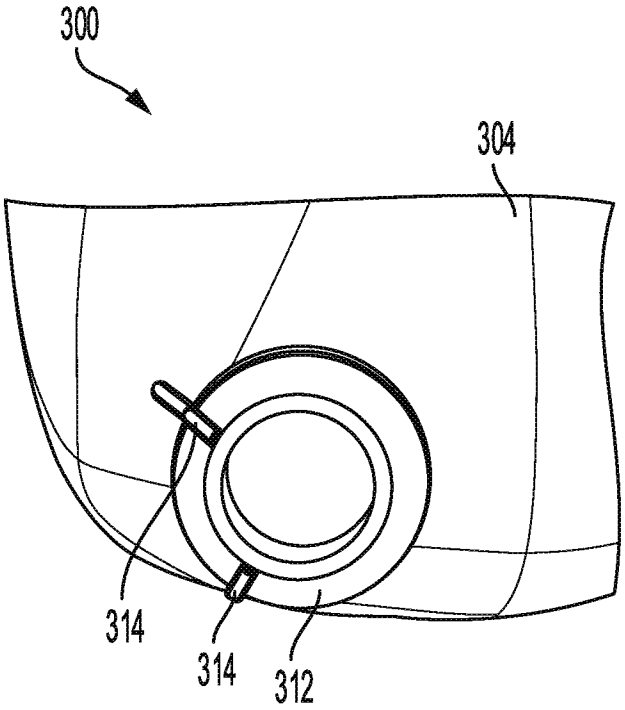
FIG. 7 depicts a top view a hosel with tripping structures.

FIG. 7 depicts a partial top view golf club head 300 with a hosel 312 with tripping structures 314. As with the other examples described above, the hosel 312 extends from the crown 304. In this example, however, only two tripping structures 314 are included on the hosel. The two tripping structures 314 are offset from one another by about 90 degrees. Both of the tripping structures 314 are incorporated on the front half of the hosel 312 as well. For instance, both tripping structures 314 are located on the striking-face side of the hosel 312 rather than rear side of the hosel 312. As discussed above, by incorporating the tripping structures 314 on the front side of the hosel, the tripping structures 314 cause the tripping effects at more points during a golf swing due to the rotation of the golf club head.

Figure 8:
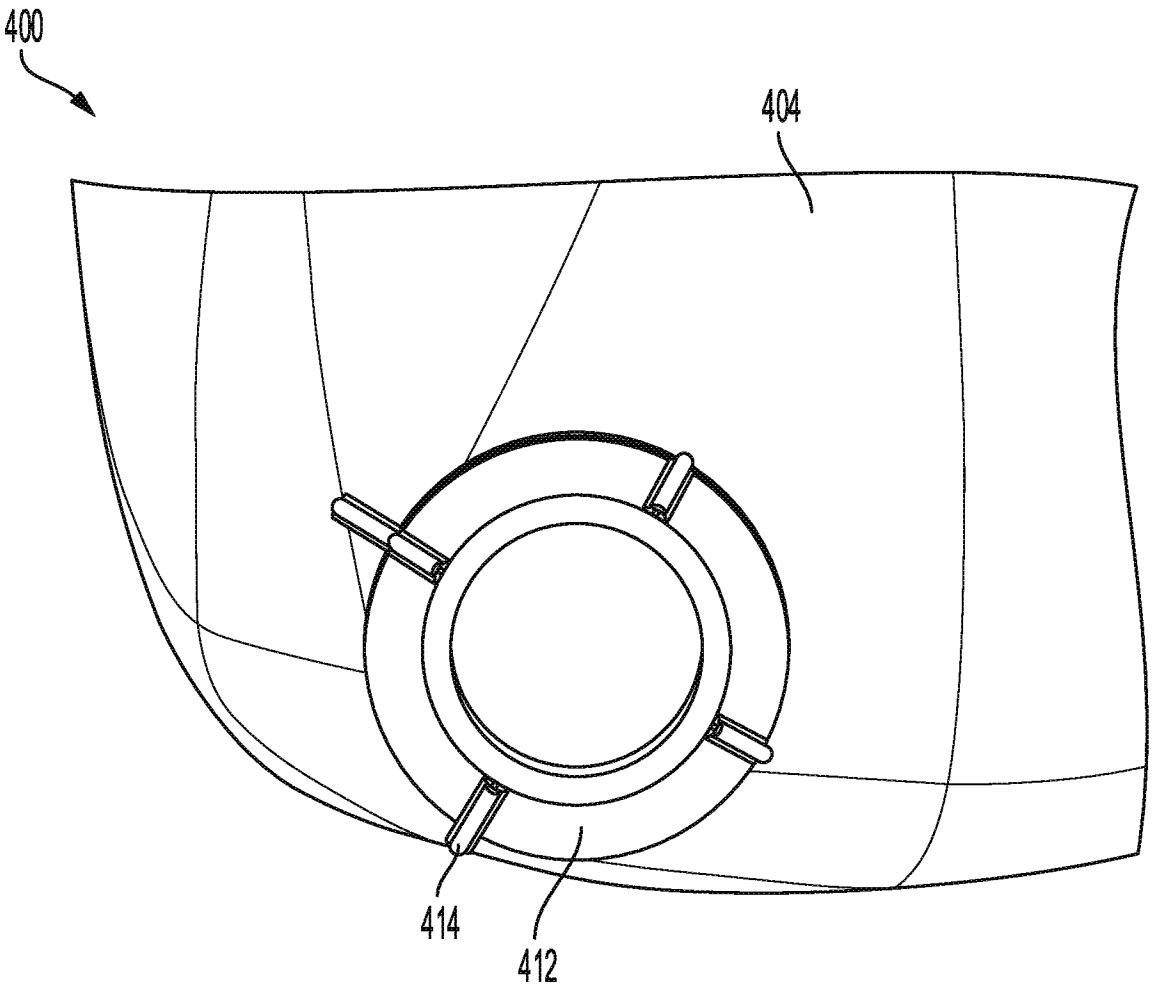
FIG. 8 depicts a top view of another hosel with tripping structures.

FIG. 8 depicts another partial top view golf club head 400 with a hosel 412 with tripping structures 414. As with the other examples described above, the hosel 412 extends from the crown 404. In this example, four tripping structures 414 are incorporated on the hosel 412. The four tripping structures 414 are offset from one another by 90 degrees. Two of the tripping structures 414 are included on the front half of the hosel 412, and two of the tripping structures 414 are included on the rear half of the hosel 412. The four tripping structures 414 and their locations may be suitable for a golf club head including an adjustable hosel components with four settings, such as the golf club head 200 discussed above with reference to FIG. 6.

Testing of prototype golf club heads have also demonstrated improvements due to the incorporation of the above tripping structures. For example, testing was performed using a control club (e.g., a club with no hosel tripping structures) and a test golf club head with tripping structures added to the hosel of the control club. Testing was performed by applying the same force to the golf clubs via a robotic swinging system in substantially the same aerodynamic conditions (e.g., location, air temperature, etc.) The results of the testing indicated that the control club had an average swing speed of 105.21–105.59 miles per hour (mph), and the testing club had an average swing speed of 106.07 mph. Thus, with the same force applied, a swing speed increase of 0.48-0.86 mph was observed based on the inclusion of the hosel tripping structures. For the testing, the tripping structures of the test club had a configuration similar to the configuration shown in FIGS. 1-5 and the tripping structures had heights of 0.012 inches. Additional testing using tripping structure configurations such as those in FIGS. 6-8 also indicated increases in swing speeds.

Figure 9:
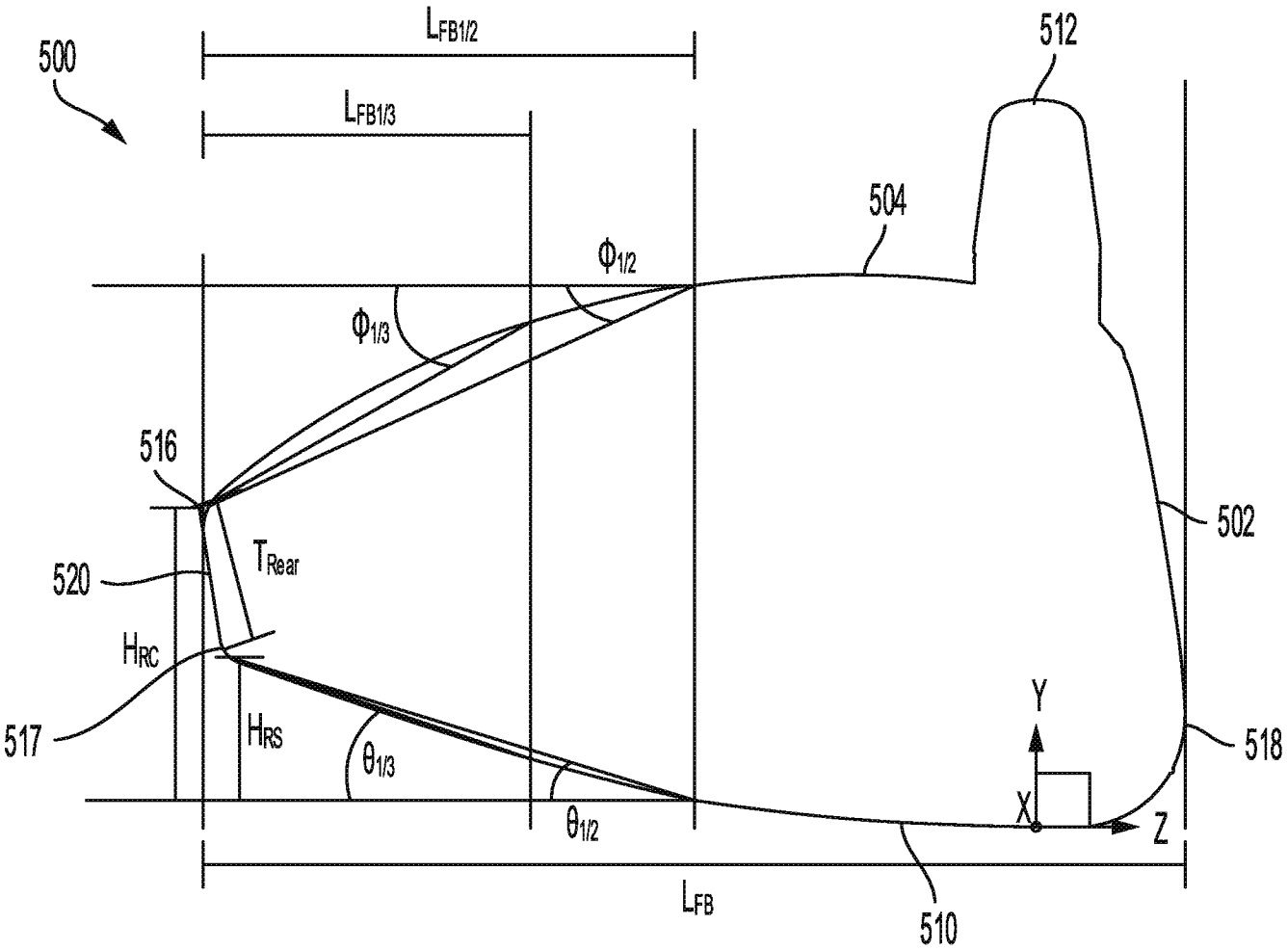
FIG. 9 depicts an example golf club head with improved drag properties.

FIG. 9 depicts an example golf club head 500 with improved drag properties. The representation of the golf club head 500 shown in FIG. 9 is a projected silhouette of the golf club from a toe-side viewpoint. The golf club head 500 shown here is setup at an address position that replicates how the golf club head 500 will interact with a golf ball. The address position, as defined by the current invention, sets up the golf club head 500 at an orientation that has a lie angle of 60 degrees similar to the requirements of the United States Golf Association (USGA). Once the lie angle is set at 60 degrees, the face angle of the golf club head 500 is set to be square, which is defined as having a face angle of 0 degrees.

Like the golf club heads described above, the golf club head 500 includes a striking face 502, a crown 504, a sole 510, and a hosel 512. The golf club head 500 also has a frontmost point 518 and a rearmost point 516. The frontmost point 518 may also be referred to as a leading edge, and the club head rearmost point 516 may also be referred to as the trailing edge.

The golf club head 500 also includes a skirt 520 or "boat tail" portion that connects the crown 504 and the sole 510. The skirt 520 may be defined as a portion of the club head 500 that is between the crown 504 and the sole 510, and defines a plane having an angle that is substantially different from the planes formed by either the crown 504 or the sole. For instance, the skirt 520 may define a plane that is within 80–120 percent of a loft angle of the golf club head 500. The angle of the plane formed by the skirt 520 may be referred to as the skirt angle. In other examples, the skirt 520 defines a plane that is within 20 degrees of being perpendicular to a ground plane defined by the ground.

The dimensions of the golf club head 500 result in the golf club head 500 experiencing lower drag during a swing of the golf club head 500. The dimensions of the golf club head 500 include a front-to-back length ($L_{FB}$), a ½ front-to-back length ($L_{FB1/2}$), and a ⅓ front-to-back length ($L_{FB1/3}$). The front-to-back length ($L_{FB}$) is the length between the club head frontmost point 518 and the club head rearmost point 516 as measured along the ground plane. The front-to-back length ($L_{FB}$) may also be referred to as the head length. The golf club head 500 also has a club head height that is measured from the lowest point on the sole to the highest point on the crown in a direction perpendicular to the ground plane.

Closing descent angles (Φ) and closing ascent angles (θ) are also defined by the golf club head 500. The closing descent angles (Φ) indicate how steeply the crown 504 is closing towards the rear of the golf club head 500. The closing ascent angles (θ) indicate how steeply the sole 510 is closing towards the rear of the golf club head 500.

The closing descent angle (Φ) is defined as an angle between (1) a line from a point on the crown 504, of the projected silhouette of the golf club from the toe-side viewpoint, to the rearmost point 516 of the crown 504 and (2) a plane intersecting the crown point and parallel to the ground plane. The rearmost point 516 of the crown 504 may be an intersection point of the crown 504 and an upper boundary of the skirt 520. The closing descent angles (Φ) may be measured from different points on the golf club head 500. For instance, a half-point closing descent angle ($\Phi_{1/2}$) may be measured from a point on the crown 504 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing descent angle ($\Phi_{1/3}$) may be measured from a point on the crown 504 that is located the ⅓ front-to-back length ($L_{FB1/3}$) from the rearmost point 516 of the golf club as measured along the ground plane. In the example depicted, the rearmost point 516 of the golf club happens to also be the rearmost point 516 of the crown 504.

The closing ascent angle (θ) is defined as an angle between (1) a line from a point on the sole 510, of the projected silhouette of the golf club from the toe-side viewpoint, to the rearmost point 517 of the sole 510 and (2) a plane intersecting the sole point and parallel to the ground plane. The rearmost point 517 of the sole 510 may be an intersection point of the sole 510 and a lower boundary of the skirt 520. The closing ascent angles (θ) may be measured from different points on the golf club head 500. For instance, a half-point closing ascent angle ($\theta_{1/2}$) may be measured from a point on the sole 510 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing ascent angle ($\theta_{1/3}$) may be measured from a point on the sole 510 that is located the ⅓ front-to-back length ($L_{FB1/3}$) from the rearmost point 516 of the golf club as measured along the ground plane.

The height and thickness of the skirt 520 also have an impact on the aerodynamics of the golf club head. The height of the skirt may be represented by the height ($H_{RS}$) of the rearmost point of the sole 510 above or off the ground plane. The rearmost point of the sole 510 represents the lowest point of the skirt 520. The height of the skirt 520 may also be represented by the height ($H_{RC}$) of the rearmost point 516 of the crown 504 off the ground plane. The thickness ($T_{Rear}$) of the rear portion the skirt 520 shown in the projection may then be defined by the distance between the rearmost point 516 of the crown 504 and the rearmost point 517 of the sole 510. For instance, the thickness ($T_{Rear}$) may be the shortest distance between the rearmost point 516 of the crown 504 and the rearmost point 517 of the sole 510 as measured in the projection.

As discussed above, configuring these dimensions of the golf club head 500 allows for improvements to the aerodynamic properties by reducing the pressure drag forces experienced by the golf club head 500 during a swing. For instance, by raising the aft portion of the skirt 520 or boat tail and/or increasing the thickness of the aft portion of the skirt 520, the closure angles of the crown 504 and the sole may be reduced and controlled. By reducing the closure angles, the separation of the turbulent flow of air over the crown 504 and/or sole 510 may be moved further rearward on the golf club head 500. Delaying the turbulent flow separation (e.g., moving the turbulent flow separation more rearward) results in a lower pressure drag forces acting on the golf club head 500 during the golf club swing. Additional reductions to pressure drag forces may be achieved by bringing the closing ascent angle (θ) closer to the closing descent angles (Φ).

As some examples, the height ($H_{RS}$) of the rearmost point of the sole 510 off the ground plane may be between 12 mm and 35 mm. The height ($H_{RC}$) of the rearmost point 516 of the crown 504 off the ground plane may be between 28 and 45 mm. The thickness of the skirt 520 ($T_{Rear}$) may be between 8 and 20 mm. Different combinations of $H_{RS}$ and $T_{Rear}$ may be utilized to achieve the aerodynamic benefits of the present technology. For example, as the skirt 520 is raised higher off the ground, the skirt 520 may not need to be as thick to achieve the shallower closure angles of the crown 504 and the sole 510. The thickness of the skirt 520 may also be adjusted based on the height of the skirt 520 to better match the closing ascent angles (θ) of the sole 510 with the closing descent angles (Φ) of the crown 504. These ranges of heights generally represent a heightened and/or thickened skirt 520 as compared to other drivers, which may have $H_{RS}$ values of about 9 mm, $H_{RC}$ values of about 22 mm, and $T_{Rear}$ values of about 16 mm.

As will also be understood, the closing ascent angles (θ) of the sole 510 and the closing descent angles (Φ) are also dependent on the height of the golf club head 500 as well as the club length or the front-to-back length (LFS). The height of the golf club head 500 for a driver may be greater than 2 inches (50.8 mm), but may be lower for other types of metal woods, such as fairway metals. In some examples, the height of the golf club head 500 may be between 2 inches (50.8 mm) and 2.8 inches (71.12 mm). For a driver, the front-to-back length ($L_{FB}$) may be between 4.13 inches (105 mm) to 4.72 inches (120 mm) or between 4 inches (101.6 mm) to 5 inches (127 mm). In some examples, the front-to-back length (LFS) may be less than 4.5 inches (114.3 mm).

Because some of the above dimensions may change as the type of metal wood changes (e.g., from drivers to fairway metals or other types of metal woods), the above dimensions may be better represented as ratios that help maintain the types closure angles of the crown 504 and the sole 510 that provide the improved aerodynamic properties discussed herein. For example, a ratio between (1) the front-to-back length (LFS) (e.g., the head length) and (2) the height ($H_{RS}$) of the rearmost point of the sole 510 off the ground plane (e.g., the skirt height) may be utilized. This ratio may be referred to as the head-length-to-skirt-height ratio. The head-length-to-skirt-height ratio may be between 3:1 and 8.5:1, between 3.4:1 and 5.8:1, or less than 6:1. The value of the head-length-to-skirt-height ratio may be based on the skirt thickness ($T_{Rear}$) as well. For instance, for the head-length-to-skirt-height ratio may be greater where the skirt thickness ($T_{Rear}$) is smaller. For instance, for a skirt thickness ($T_{Rear}$) between 10–14 mm, the head-length-to-skirt-height ratio may be between 3.46:1 and 5.7:1. For a skirt thickness ($T_{Rear}$) between 16–18 mm, the head-length-to-skirt-height ratio may be between 4.3:1 and 8.5:1.

A ratio between the head length and skirt thickness ($T_{Rear}$) may also be utilized, and such a ratio may be referred to as a head-length-to-skirt-thickness ratio. The head-length-to-skirt-thickness ratio may be between 6:1 and 11:1, between 6.5:1 and 8.5:1, or less than 9:1. The head-length-to-skirt-thickness ratio may also depend on the skirt height similar to how the head-length-to-skirt-height ratio is dependent on the skirt thickness, as discussed above.

The closing descent angles (Φ) and the closing ascent angles (θ) of sole may be within ranges of degrees and the angles may be based on one another to more closely match the closing descent angles (Φ) to the closing ascent angles (θ). The half-point closing descent angle ($\Phi_{1/2}$) may be between 15 and 30 degrees, less than 30 degrees, or less than 20 degrees. The third-point closing descent angle ($\Phi_{1/3}$) 20 and 35 degrees, less than 35 degrees, less than 30 degrees, or less than 25 degrees. For instance, half-point closing ascent angle ($\theta_{1/2}$) may be between 15 and 30 degrees, less than 30 degrees, or less than 20 degrees. The third-point closing ascent angle ($\theta_{1/3}$) may be between 10–35 degrees, less than 35 degrees, or less than 20 degrees. As the closing descent angles (Φ) and the closing ascent angles (θ) become shallower, the golf club head 500 may incur less pressure drag effects.

In addition, as the closing descent angles (Φ) and the closing ascent angles (θ) become more closely matched, the golf club head 500 may also receive less pressure drag effects. For instance, in some examples the respective closing descent angles (Φ) and the closing ascent angles (θ) may be within 85% to 115% of one another. In another example, the respective closing descent angles (Φ) and the closing ascent angles (θ) may be within 95% to 105% of one another. For example, the half-point closing descent angle ($\Phi_{1/2}$) may be within 85% to 115% or 95% to 105% of the half-point closing ascent angle ($\theta_{1/2}$). Similarly, the third-point closing descent angle ($\Phi_{1/3}$) may be within 85% to 115% or 95% to 105% of the third-point closing ascent angle ($\theta_{1/3}$).

Additionally or alternatively, there may be no tangent line to the aft half of the crown 504 in the projected silhouette that is greater than 45 degrees, 40 degrees, or 30 degrees. Stated another way, all tangent lines that can be drawn on the aft half of the crown 504 in the projected silhouette may have an angle relative to the ground plane that is less than or equal to 45 degrees, 40 degrees, or 30 degrees. Similarly, there may be no tangent line to the aft half of the sole 510 in the projected silhouette that is greater than 45 degrees, 40 degrees, or 30 degrees. Stated another way, all tangent lines that can be drawn on the aft half of the sole 510 in the projected silhouette may have an angle relative to the ground plane that is less than or equal to 45 degrees, 40 degrees, or 30 degrees.

The table provided in FIG. 10 includes a listing of dimensions for ten example golf club heads that have dimensions based on the present technology to alter the closing angles of the sole and crown of the respective golf clubs. As can be seen from the data in the table, many of the example clubs satisfy the above relationships and characteristics.

Figure 11:
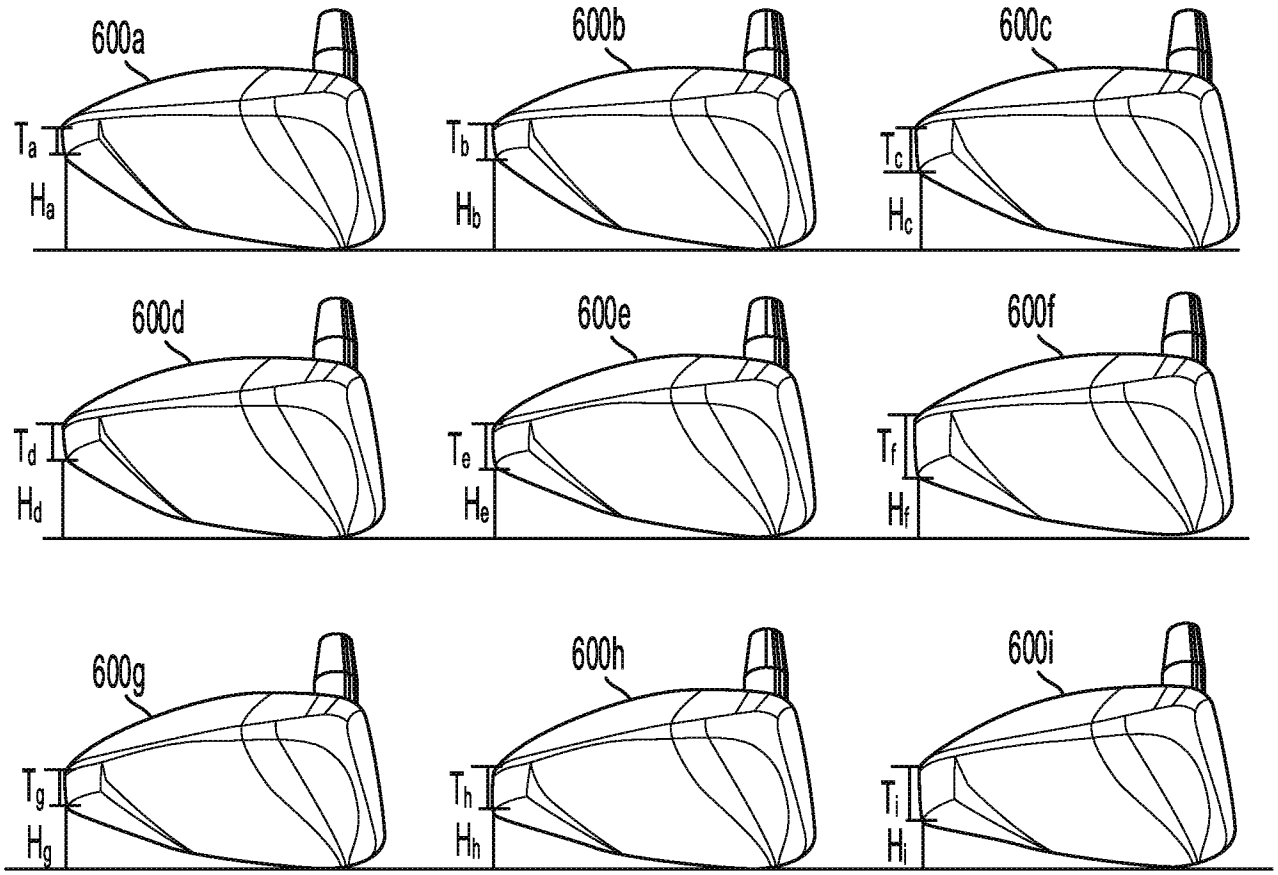
FIG. 11 depicts examples of golf club heads with improved drag properties.

FIG. 11 depicts examples of golf club heads with improved drag properties. The example golf clubs 600*a-i* in FIG. 11 each have different combinations of skirt thickness and skirt heights. In FIG. 11, the skirt thicknesses are labeled with a T and the skirt heights are indicated with an H. The skirt thicknesses (T) in FIG. 11 may be the same or substantially the same dimension as the thickness ($T_{Rear}$) of the rear portion the skirt, discussed above in FIG. 9. The skirt heights (H) may be the same dimension as the height ($H_{RS}$) of the rearmost point of the sole 510 off the ground plane, as discussed above in FIG. 9.

Golf club 600*a* has a skirt thickness of $T_a$ and a skirt height of $H_a$. Golf club 600*b* has a skirt thickness of $T_b$ and a skirt height of $H_b$. Golf club 600*c* has a skirt thickness of $T_c$ and a skirt height of $H_c$. Golf club 600*d* has a skirt thickness of Td and a skirt height of $H_a$. Golf club 600*e* has a skirt thickness of $T_e$ and a skirt height of $H_e$. Golf club 600*f* has a skirt thickness of $T_f$ and a skirt height of $H_f$. Golf club 600*g* has a skirt thickness of $T_g$ and a skirt height of $H_g$. Golf club 600*h* has a skirt thickness of $T_h$ and a skirt height of $H_h$. Golf club 600*i* has a skirt thickness of $T_i$ and a skirt height of $H_i$.

As can be seen in the first row of golf club heads 600*a-c*, raising the skirt height allows for a shallower closing descent angle of the crown. However, with thinner skirt thicknesses, the closing ascent angle of the sole is quite steep. As the thickness of the skirt become increasingly greater from golf club head 600*a* to golf club head 600*c*, it can be seen that the closing ascent angle of the sole becomes shallower and becomes closer to the closing descent angle of the crown.

Similar results are seen in the second row, which includes example golf club heads 600*d-f*. The skirt heights (T) of the golf club heads 600*d-f* is less than the skirt heights (T) of the golf club heads 600*a-c* in the first row. The lower skirt height (T) in golf club heads 600*d-f* result in a steeper closing descent angle of the crown but also results in a shallower closing ascent angle of the crown-especially as the skirt thickness increases.

In the last row, which includes example golf club heads 600*g-i*, the skirt heights (H) are generally lower than that of the respective golf club heads 600*a-f* in the first and second row. By moving the skirt height even lower, the closing ascent angle of the sole is further reduced, but the closing descent angle begins to increase more dramatically. As the skirt thickness (T) increases, the closing ascent angle of the sole further decreases to point that it is shallower than the closing descent angle of the crown.

Testing of prototype golf club heads have also shown improvements due to the incorporation of the aerodynamic shaping to modify the skirt heights and thicknesses along with the closing angles. For example, testing was performed using a control club (e.g., a club with a more traditional low skirt height) and a test golf club heads with raised skirts. Testing was performed by applying the same force to the golf clubs via a robotic swinging system in substantially the same aerodynamic conditions (e.g., location, air temperature, etc.) In testing, raising the skirt by 0.25 inches resulted in an increase in club head speed of 0.44 mph, and raising the skirt by 0.5 inches resulted in increases in club head speed of between 0.57–0.91 mph. Golf club heads that included both the raised skirt and the tripping structures discussed above resulted in a combined even greater increase in swing speed.

Figure 12:
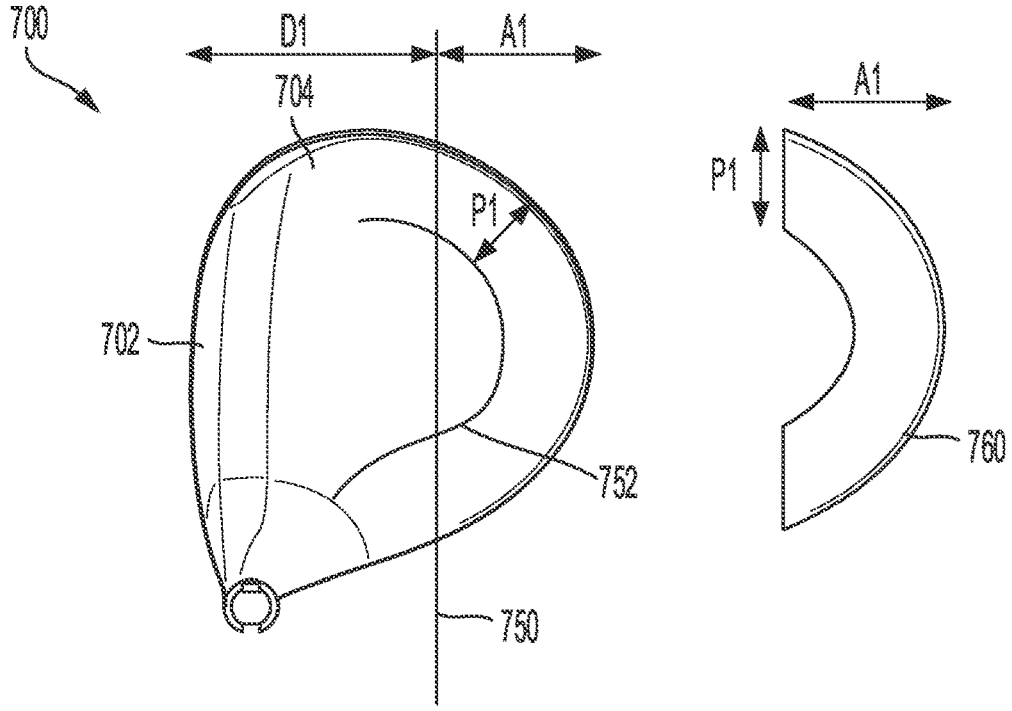
FIG. 12 depicts a top view of an example golf club head and an example aft slice.

FIG. 12 depicts a top view of an example golf club head 700 and an example aft slice 760. The example golf club head 700 may be similar or the same as the golf club heads discussed above. For instance, the golf club head 700 includes a crown 704 and a striking face 702.

Raising the skirt and/or thickening the skirt also generally raises the aft portion of the club head 700 to improve the aerodynamic properties of the golf club. To identify the characteristics of the aft portion of the club head 700, an aft slice 760 of the golf club head 700 may be considered. The aft slice 760 is a portion of the golf club head 700 to the rear of a slice line 750 and between an outer perimeter of the golf club head 700 and an offset perimeter slice curve 752. The slice line 750 runs in the heel-to-toe direction (e.g., parallel with a heel-to-toe axis) and is located a slice depth D from the frontmost point of the golf club head. The offset perimeter slice curve 752 is offset from the outer perimeter of the golf club head 700 by a perimeter offset distance P. The offset perimeter slice curve 752 follows the outline or contour of the outer perimeter at the offset position. For instance, an aft portion of the golf cub head 700 to the rear of the slice line 750 may be identified. A perimeter portion that is offset by the perimeter-offset distance P from the outer perimeter of that aft portion is then extracted or identified to form or define the aft slice 760. The aft slice 760 may be formed or extracted computationally by generating a three-dimensional scan of the golf club head or other computer modelling of the golf club head. In the example depicted in FIG. 12, the slice depth D1 is 60% of the front-to-back length of the club head 700 measured from the frontmost point of the golf club head, and the perimeter offset distance P1 is 1.0 inches.

The aft slice 760 also has an aft depth A that is measured from rearmost point of the aft slice 760 to the frontmost point of the aft slice 760 (e.g., slice line 750). The aft depth A of the aft slice 760 is equal to the difference of the front-to-back length of the club head 700 and the slice depth D. In the example depicted in FIG. 12, the aft depth A1 of the aft slice 760 is equal to 40% of the front-to-back length of the club head 700.

Figure 13:
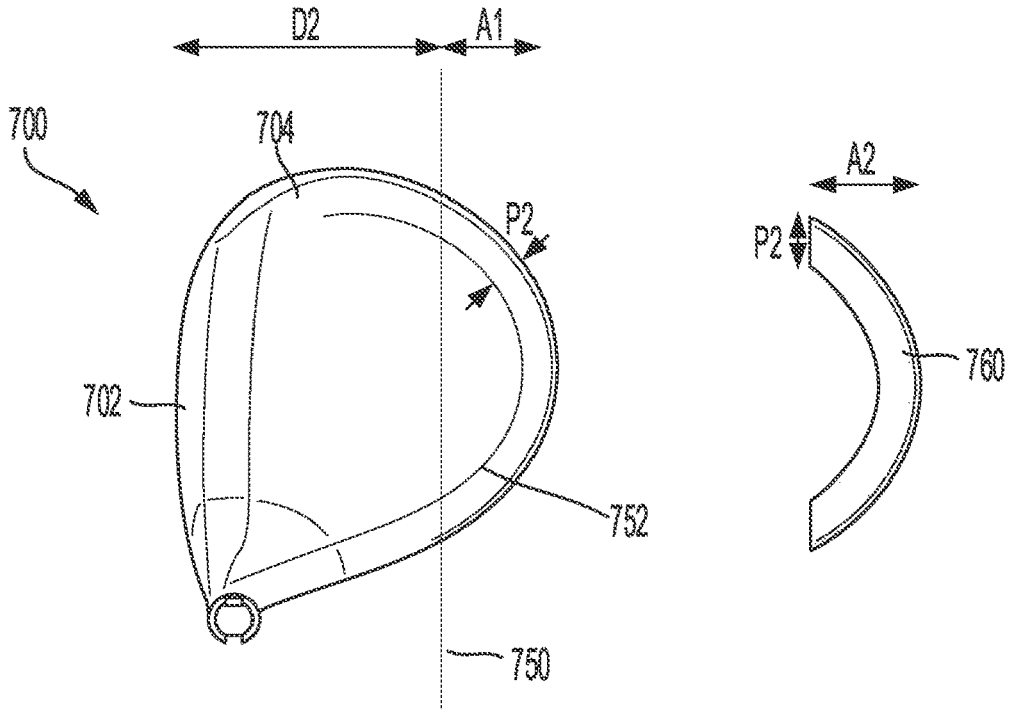
FIG. 13 depicts a top view of an example golf club head and another example aft slice.

FIG. 13 depicts a top view of an example golf club head 700 and another example aft slice 760. The aft slice in FIG. 13 differs from the aft slice 760 in FIG. 12 in that the slice depth D2 is greater than the slice depth D1, and the perimeter-offset distance P2 is less than the perimeter-offset distance P1. Because the slice depth D2 is greater than the slice depth D1, the aft depth A2 is less than the aft depth A1. In the example depicted in FIG. 13, the slice depth D2 is 70% of the front-to-back length of the golf club head 700, the aft depth A2 is 30% of the front-to-back length of the golf club head 700, and perimeter-offset distance P2 is 0.5 inches.

Figure 14:
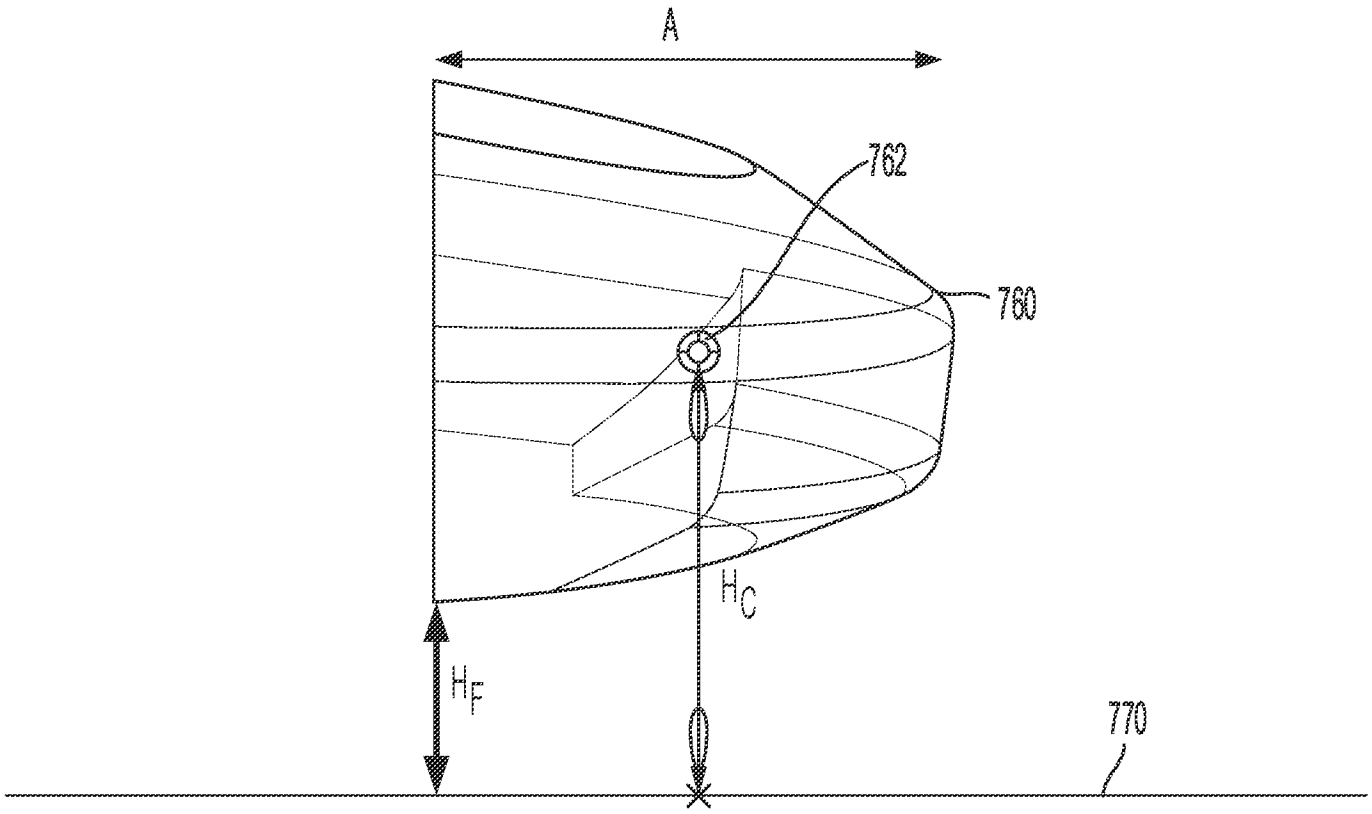
FIG. 14 depicts a side view of an example aft slice.

FIG. 14 depicts a side view of an example aft slice 760. More specifically, FIG. 14 depicts a projected silhouette of the aft slice 760 from a side view, which may be from a toe-side viewpoint or a heel-side viewpoint. The projected silhouette is generated with the golf club head 700 (from which the aft slice 760 is generated) setup at an address position that replicates how the golf club head 700 will interact with a golf ball. The address position, as defined by the current invention, sets up the golf club head 700 at an orientation that has a lie angle of 60 degrees similar to the requirements of the USGA. Once the lie angle is set at 60 degrees, the face angle of the golf club head 700 is set to be square, which is defined as having a face angle of 0 degrees.

Two dimensions of the aft slice 760 may be acquired or determined from the projected side-view silhouette of the aft slice 760. The first dimension is a height ($H_{centroid}$) of a centroid 762 of the aft portion 760 above a ground plane 770. A centroid of an object may be considered the center of gravity of the solid object assuming uniform density. To calculate the centroid 762 of the aft slice 760, all internal geometry of the aft slice 760 may be filled in (mathematically, computationally, etc.) to be a solid object and assumed to have the same density throughout. The center of gravity of that solid object may then be determined or calculated as the centroid 762. The second dimension is a height ($H_{Low}$) of the lowest point of the aft slice 760, in the silhouette, above the ground plane 770.

In examples where the slice depth D is 60% of the front-to-back length of the golf club head 700, the aft depth A is 40% of the front-to-back length of the golf club head 700, and perimeter-offset distance P is 1.0 inches, the height ($H_{Low}$) of the lowest point of the aft slice 760 may be between 5–10 mm, and the centroid height ($H_{centroid}$) may be between 28–35 mm. For example, the height ($H_{Low}$) of the lowest point of the aft slice 760 may be greater than 6 mm, and the centroid height ($H_{centroid}$) may be greater than 29 mm.

In examples where the slice depth D is 70% of the front-to-back length of the golf club head 700, the aft depth A is 30% of the front-to-back length of the golf club head 700, and perimeter-offset distance P is 0.5 inches, the height ($H_{Low}$) of the lowest point of the aft slice 760 may be between 10–15 mm, and the centroid height ($H_{centroid}$) may be between 28–35 mm. For example, the height ($H_{Low}$) of the lowest point of the aft slice 760 may be greater than 10, 11, or 12 mm, and the centroid height ($H_{centroid}$) may be greater than 28 mm. In some examples, the centroid height ($H_{centroid}$) may be at least 50% of the club head height of the golf club head 700. In some examples, the centroid height ($H_{centroid}$) that is at least 95% of a height of a geometric center of the striking face 702 above a ground plane. For instance, the centroid height ($H_{centroid}$) may also be greater than or equal to a height of a geometric center of the striking face 702. The height ($H_{Low}$) of a lowest point of the aft slice is at least 40%, 45%, or 50% of the height of the geometric center of the striking face above the ground plane.

Golf club heads having aft slices 760 with the dimensions discussed above have been shown through testing to have improved aerodynamic properties similar to those discussed above with respect to FIGS. 9-11.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A metal-wood type golf club head having improved aerodynamic properties, the golf club head having a club head frontmost point and a club head rearmost point, and the golf club head comprising:

a striking face, the striking face defining the frontmost point;

a sole connected to a bottom side of the striking face, the sole having a rearmost point and a closing ascent angle of less than about 35 degrees, wherein the closing ascent angle is:

an angle between (1) a line from the rearmost point of the sole to a sole point, of a projected silhouette of the golf club head from a toe-side viewpoint, located one third a front-to-back length from the club head rearmost point, as measured along a ground plane, and (2) a plane intersecting the sole point and parallel to the ground plane;

a crown connected to a topside of the striking face, the crown including a rearmost point and a closing descent angle of less than about 35 degrees, wherein the closing descent angle is:

an angle between (1) a line from the rearmost point of the crown to a crown point, of the projected silhouette of the golf club head from the toe-side viewpoint, located one third the front-to-back length from the club head rearmost point, as measured along the ground plane, and (2) a plane intersecting the crown point and parallel to the ground plane; and within 85%–115% of the closing ascent angle of the sole; and a skirt, wherein the rearmost point on the sole is an intersection point of the sole and a lower boundary of the skirt, and the rearmost point on the crown is an intersection point of the crown and an upper boundary of the skirt, and wherein the lower boundary is a skirt height above the ground plane, and the skirt height satisfies a head-length-to-skirt-height ratio between 3:1 and 8:1.

2. The metal-wood type golf club head of claim 1, wherein a club head height of the golf club head is at least 2 inches, and a club head length is greater than 4.0 inches.

3. The metal-wood type golf club head of claim 1, wherein the skirt height is between 12–35 mm.

4. The metal-wood type golf club head of claim 1, wherein the skirt has a skirt thickness that satisfies a head-length-to-skirt-thickness ratio of 6:1 and 11:1.

5. The metal-wood type golf club head of claim 4, wherein the skirt thickness is between 8–20 mm.

6. The metal-wood type golf club head of claim 1, wherein the closing ascent angle is less than about 30 degrees and the closing descent angle is less than about 30 degrees.

7. The metal-wood type golf club head of claim 1, wherein the closing descent angle is within 95%–105% of the closing ascent angle of the sole.

8. The metal-wood type golf club head of claim 1, further comprising a hosel at a heelward side of the golf club head, the hosel including a hosel opening configured to receive a golf club shaft defining a shaft axis, wherein the hosel includes:

a first tripping structure extending in a direction from the hosel opening towards the sole, the first tripping structure having a height or depth, as measured from an outer surface of the hosel adjacent to the first tripping structure, of between 0.005 inch and 0.03 inch; and a second tripping structure extending in the direction from the hosel opening towards the sole, the second tripping structure having a height or depth, as measured from an outer surface of the hosel adjacent to the second tripping structure, of between 0.005 inch and 0.03 inch and the second tripping structure located apart from the first tripping structure by an angular position of 70–170 degrees, as measured around the shaft axis, wherein the skirt includes an aft skirt portion at a rear of the golf club head, wherein the aft skirt portion has a skirt thickness that satisfies a head-length-to-skirt-thickness ratio of 5:1 and 14:1.

9. The golf club head of claim 8, wherein the skirt thickness is between 8–20 mm.

10. The golf club head of claim 8, wherein the skirt height is between 12–35 mm.

11. The metal-wood type golf club head of claim 1, further comprising a hosel at a heelward side of the golf club head, the hosel including a hosel opening configured to receive a golf club shaft defining a shaft axis, wherein the hosel includes:

a toeward tripping structure extending in a direction from the hosel opening towards the sole, the toeward tripping structure having a height or depth, as measured from an outer surface of the hosel adjacent to the toeward tripping structure, of between 0.005 inch and 0.03 inch, the toeward tripping structure being positioned at a shaft-axis angular position of 0–80 degrees measured around the shaft axis, wherein a zero-degree shaft-axis angular position corresponds to a direction forward of the golf club head and perpendicular to a plane defined by the striking face; and a heelward tripping structure extending in the direction from the hosel opening towards the sole, the heelward tripping structure having a height or depth, as measured from an outer surface of the hosel adjacent to the heelward tripping structure, of between 0.005 inch and 0.03 inch, the heelward tripping structure being positioned at a shaft-axis angular position of 260–340 degrees measured around the shaft axis.

12. The golf club head of claim 11, wherein a position of the toeward tripping structure and a position of the heelward tripping structure are substantially symmetric about a line extending along a 350 degree shaft-axis angle.

13. The golf club head of claim 12, wherein the toeward tripping structure is located at a shaft-axis angular position of 30–60 degrees and the heelward tripping structure is located at a shaft-axis angular position of 280–310 degrees.

14. The golf club head of claim 11, wherein the heelward tripping structure is located apart from the toeward tripping structure by angular position of less than 100 degrees, as measured around the shaft axis.

15. The golf club head of claim 11, further comprising a second toeward tripping structure and a third toeward tripping structure, the second toeward tripping structure and the third toeward tripping structure located within 30 degrees of the toeward tripping structure, as measured around the shaft axis.

16. The golf club head of claim 11, wherein:

the toeward tripping structure is one of a ridge or a groove; and wherein the heelward tripping structure is one of a ridge or a groove.

17. The golf club head of claim 11, wherein the toeward tripping structure has a length of 30 mm to 70 mm, and wherein the hosel is configured to cause tripping from laminar flow to turbulent flow around the hosel at a Reynolds number of 20,000 to 50,000.

18. The golf club head of claim 11, wherein the hosel is adjustable and includes an adjustable component having multiple setting positions, wherein the adjustable component includes a plurality of first tripping structure portions, the hosel includes a plurality of second tripping structure portions, and the adjustable component is configured such that, at each of the multiple setting positions, one of the plurality of first tripping structure portions aligns with one of the plurality of second tripping structure portions.

19. The metal-wood type golf club head of claim 1, wherein an aft slice of the golf club head has a centroid height ($H_{Centroid}$) that is at least 95% of a height of a geometric center of the striking face above a ground plane and a height ($H_{Low}$) of a lowest point of the aft slice is at least 40% of the height of the geometric center of the striking face above the ground plane, the aft slice being a portion of the golf club head to a rear of a first slice line and between an outer perimeter of the golf club head and an offset perimeter slice curve, wherein:

the first slice line extends in a heel-to-toe direction and is located a first slice depth rearward from the frontmost point, the first slice depth being equal to 70% of a front-to-back length of the golf club head; and the offset perimeter slice curve is offset from the outer perimeter of the golf club head by a perimeter offset distance of 0.5 inch.

20. The golf club head of claim 19, wherein the centroid height is equal to at least 50% of a club head height of the golf club head.

21. The golf club head of claim 19, wherein the centroid height is at least 28 mm.

22. The golf club head of claim 19, wherein a club head height of the golf club head is 2.0 to 2.8 inches, and a club head length of the golf club head is 4.0 to 5.0 inches.

23. The golf club head of claim 19, wherein the centroid height ($H_{Centroid}$) is less than 35 mm.

24. The golf club head of claim 19, wherein the height ($H_{Low}$) of the lowest point of the aft slice is at least 10 mm and less than 15 mm above the ground plane.

25. The golf club head of claim 19, wherein a second aft slice of the golf club head has a centroid height ($H_{Centroid}$) of at least 28 mm and a height ($H_{Low}$) of a lowest point of the second aft slice is greater than 6 mm above the ground plane, the second aft slice being a portion of the golf club head to a rear of a second slice line and between the outer perimeter of the golf club head and a second perimeter slice curve, wherein:

the second slice line extends in the heel-to-toe direction and is located a second slice depth rearward from the frontmost point, the second slice depth being equal to 60% of the front-to-back length of the golf club head; and the second perimeter slice curve is offset from the outer perimeter of the golf club head by a second perimeter offset distance of 1.0 inch.

* * * * *